US007747204B2

(12) United States Patent
Satoh et al.

(10) Patent No.: US 7,747,204 B2
(45) Date of Patent: Jun. 29, 2010

(54) DEVELOPING ROLLER, DEVELOPING ASSEMBLY, PROCESS CARTRIDGE AND ELECTROPHOTOGRAPHIC IMAGE FORMING APPARATUS

(75) Inventors: Hidenori Satoh, Odawara (JP); Kenichi Yamauchi, Susono (JP); Genya Anan, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/208,726

(22) Filed: Sep. 11, 2008

(65) Prior Publication Data

US 2009/0010684 A1 Jan. 8, 2009

Related U.S. Application Data

(63) Continuation of application No. PCT/JP2008/058292, filed on Apr. 23, 2008.

(30) Foreign Application Priority Data

Apr. 27, 2007 (JP) ..... 2007-118782

(51) Int. Cl.
*G03G 15/08* (2006.01)

(52) U.S. Cl. ..... 399/286

(58) Field of Classification Search ..... 399/286
See application file for complete search history.

(56) References Cited

U.S. PATENT DOCUMENTS 6,393,243 B1 5/2002 Satoh et al.
6,484,007 B1 * 11/2002 Ozeki et al. ..... 399/286
6,778,791 B2 8/2004 Shimizu et al.
6,801,738 B2 10/2004 Oba et al.
6,882,814 B2 4/2005 Satoh et al.
6,963,700 B2 11/2005 Shimizu et al.
7,099,613 B2 8/2006 Nakamura et al.
2003/0215731 A1 * 11/2003 Saiki et al. ..... 399/286

FOREIGN PATENT DOCUMENTS

JP 8-160736 A 6/1996

(Continued)

OTHER PUBLICATIONS

Toshio Hata, et al., "Estimation of the Surface Energy of Polymer Solids," The Journal of Adhesion, vol. 21, Nos. 3-4 (1987), pp. 177-194.

(Continued)

*Primary Examiner*—David M Gray
*Assistant Examiner*—Erika Villaluna
(74) *Attorney, Agent, or Firm*—Fitzpatrick, Cella, Harper & Scinto

(57) ABSTRACT

A developing roller is provided which is soft enough to enable toners to be kept from deteriorating with time and cannot easily cause permanent set. The developing roller includes a mandrel, an elastic-material layer and a cover layer as a surface layer which covers the elastic-material layer. Asker-C hardness at the surface of the cover layer is from 40° to 85°. The cover layer has a thickness of from 15 nm to 5,000 nm. Martens hardness H1 ($N/mm^2$) at the surface of the developing roller, Martens hardness H2 ($N/mm^2$) of the elastic-material layer and the thickness d (mm) of the cover layer satisfy the relationship of the following expression (1):

$$400 \leqq (H1-H2)/d \leqq 2{,}000 \quad (1).$$

10 Claims, 4 Drawing Sheets

FOREIGN PATENT DOCUMENTS

| | | | |
|---|---|---|---|
| JP | 2001-27843 | A | 1/2001 |
| JP | 2001-166533 | A | 6/2001 |
| JP | 2003-270926 | A | 9/2003 |
| JP | 2004-109206 | A | 4/2004 |
| JP | 2005-121728 | A | 5/2005 |
| JP | 2005-248084 | A | 9/2005 |
| JP | 2006-106323 | A | 4/2006 |
| JP | 2006-184446 | A | 7/2006 |
| JP | 2007-94192 | A | 4/2007 |

OTHER PUBLICATIONS

International Search Report, dated Jun. 17, 2008, of PCT/JP2008/058292, filed Apr. 23, 2008.

* cited by examiner

DEVELOPING ROLLER, DEVELOPING ASSEMBLY, PROCESS CARTRIDGE AND ELECTROPHOTOGRAPHIC IMAGE FORMING APPARATUS

This application is a continuation of International Application No. PCT/JP2008/058292, filed on Apr. 23, 2008, which claims the benefit of Japanese Patent Application No. 2007-118782 filed on Apr. 27, 2007.

BACKGROUND OF THE INVENTION

1. Field of the Invention

This invention relates to a developing roller used in contact with an image-bearing member (photosensitive drum) set in an image forming apparatus employing an electrophotographic system, such as a copying machine, a printer or a facsimile receiving set, and also to a developing assembly, a process cartridge and an electrophotographic image forming apparatus which use the same.

2. Description of the Related Art

It is substantially essential for the developing roller to be provided with an elastic-material layer containing a rubber component or a resin component, in order to secure the nip width between the elastic-material layer and the photosensitive drum. In order that any low-molecular component which may ooze out of such an elastic-material layer can be kept from adhering to the photosensitive drum, a configuration is employed such that a cover layer is provided on the elastic-material layer.

Asker-C hardness of the developing roller is closely concerned with deterioration of toner with time. More specifically, too high Asker-C hardness may accelerate the deterioration of toner with time. Hence, it has conventionally been proposed that the Asker-C hardness of the developing roller is set to be in the range of from 25° or more to 85° or less [see, e.g., Japanese Patent Applications Laid-open No. 2001-166533 (Patent Document 1) and No. 2005-121728 (Patent Document 2)].

As another problem in the developing roller in which the presence of the elastic-material layer is essential as stated above, there is partial permanent set that comes about when a contact member such as a photosensitive drum and a cleaning blade is kept in contact with one another over a long period of time. When electrographic images are formed by using a developing roller in which such partial permanent set has occurred, faulty images may be brought about correspondingly to the part where the permanent set has come about.

Thus, it has hitherto been noted as a problem to be resolved that a developing roller in which the permanent set cannot easily be caused while having a low hardness. For example, Japanese Patent Applications Laid-open No. 2006-106323 (Patent Document 3) and No. 2005-248084 (Patent Document 4) disclose developing rollers made up variously so as to resolve such a problem. However, according to studies made by the present inventors, it can not necessarily be said that conventionally proposed developing rollers have been made sufficiently effective in resolving such a problem, and they have come to realize that a novel developing roller should be created which can resolve the problem at a higher level.

SUMMARY OF THE INVENTION

Accordingly, an object of the present invention is to provide a developing roller which is soft enough to enable toners to be kept from deteriorating with time and in which the permanent set cannot easily be brought about.

The present inventors have made extensive studies to resolve the above problem. As a result, they have discovered that the problems can be resolved at a high level in a case where a cover layer having a specific hardness and also a very small thickness is formed as a surface layer on a soft elastic-material layer. The present invention has been accomplished on the basis of such a new finding.

That is, the developing roller according to the present invention is a developing roller including a mandrel, an elastic-material layer and a cover layer as a surface layer which covers the elastic-material layer, wherein; the developing roller has an Asker-C hardness of 40° or more and 85° or less at the surface of the cover layer, the cover layer has a thickness of 15 nm or more and 5,000 nm or less, and Martens hardness H1 ($N/mm^2$) at the surface of the developing roller, Martens hardness H2 ($N/mm^2$) of the elastic-material layer and the thickness d (mm) of the cover layer satisfy a relationship of the following expression (1):

$$400 \leqq (H1-H2)/d \leqq 2{,}000 \quad (1).$$

According to the present invention, a developing roller can be obtained which can constantly provide high-grade electrographic images because the hardness is low and the permanent set is difficult to bring about.

Further features of the present invention will become apparent from the following description of exemplary embodiments with reference to the attached drawings.

DESCRIPTION OF THE EMBODIMENTS

The present invention is described below in derail.

The developing roller according to the present invention holds a toner and feed the toner to the surface of a latent image bearing member on which an electrostatic latent image has been formed to render the electrostatic latent image visible in an electrophotographic image forming apparatus. The developing roller has a mandrel, an elastic-material layer formed on the peripheral surface of the mandrel, and a cover layer as a surface layer which covers the elastic-material layer. The developing roller also fulfills the following requirements (a) to (c):

(a) The Asker-C hardness of the surface is 40° or more and 85° or less;

(b) The thickness of the cover layer is 15 nm or more and 5,000 nm or less; and (c) the Martens hardness H1 ($N/mm^2$) of the developing roller surface, the Martens hardness H2 ($N/mm^2$) of the elastic-material layer and the layer thickness d (mm) of the cover layer satisfy the relationship of the following expression (1):

$$400 \leqq (H1-H2)/d \leqq 2{,}000 \quad (1).$$

When the requirements (a) to (c) are fulfilled, the developing roller has a low hardness and also good deformation recovery properties. As a result, the developing roller can reduce the stress to be applied to toner and can effectively keep toner from deteriorating with time. In addition, the developing roller has a relatively hard cover layer as a surface layer, and the partial permanent set cannot easily be caused even when the contact members are kept in contact with the developing roller at its specific portion over a long period of time.

Figure 1:
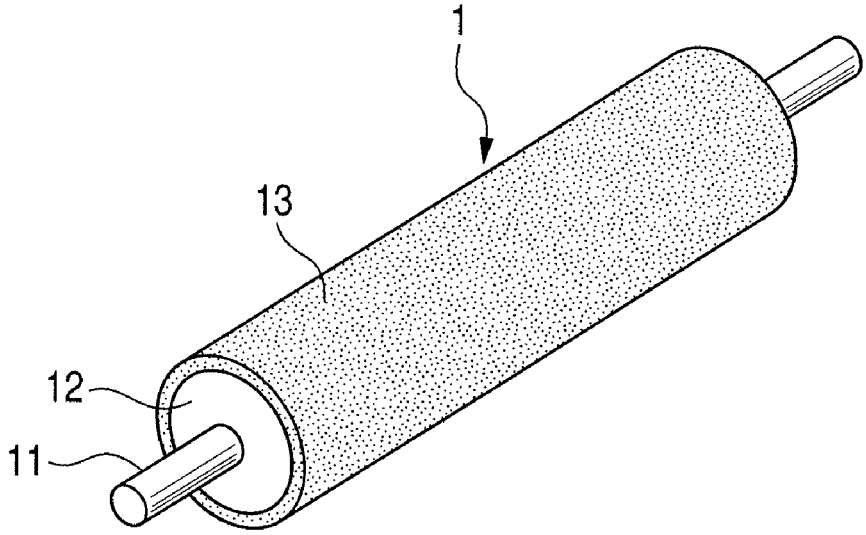
FIG. 1 is a view diagrammatically showing the entire configuration of an example of a developing roller according to the present invention.
Figure 2:
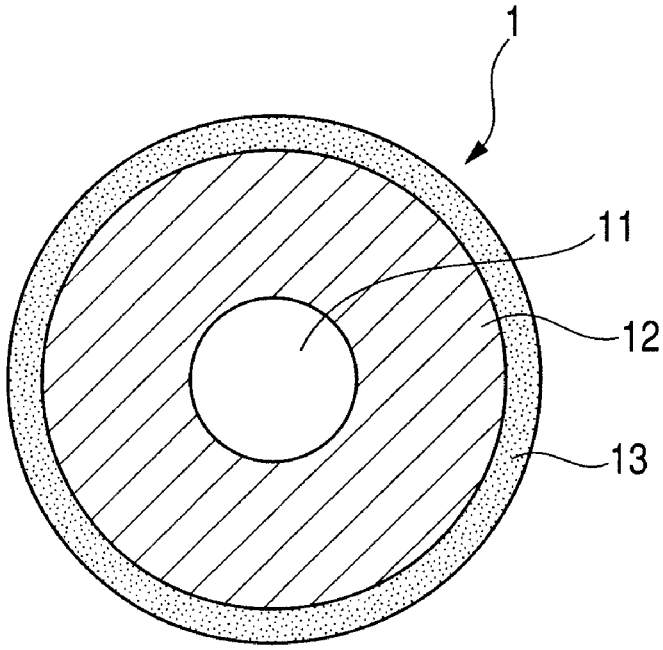
FIG. 2 is a view diagrammatically showing a section of a developing roller of the present invention at a face crossing at right angles with a mandrel.

An example of an embodiment of the developing roller according to the present invention is shown in FIGS. 1 and 2. FIG. 1 is a view diagrammatically showing the entire configuration of an example of the developing roller according to the present invention. FIG. 2 is a view diagrammatically showing a section of the developing roller at a face crossing at right angles with the mandrel. A developing roller 1 embodied as shown in FIGS. 1 and 2 includes a mandrel 11, and an elastic-material layer 12 and a cover layer in this order formed on the outer peripheral surface of the mandrel.

<Mandrel>

The mandrel 11 having the shape of a column or cylinder, formed from a conductive material such as a metal, may be used. The developing roller used in image forming apparatus is commonly used in a state that an electric bias is applied or in a grounded state, and hence the mandrel 11 is a support member and functions also as an electrode of the developing roller.

Accordingly, the mandrel 11 is, at least at its outer peripheral surface, made up of a material having electrical conductivity sufficient to apply a given voltage to the rubber-containing elastic-material layer to be formed thereon. Specifically, such a material may include metals or alloys, such as aluminum, copper alloys and stainless steel, or iron plated with chromium or nickel, and synthetic resins made electrically conductive. In the developing roller used in an image forming apparatus, the mandrel may normally have an outer diameter in the range of from 4 mm to 10 mm.

<Elastic-Material Layer>

The elastic-material layer 12 is a layer having flexibility, and a molded product may be used which is chiefly composed of a rubber as a raw material. As the raw-material chief-component rubber, various rubbers may be used which are conventionally used in elastic rollers. Specific examples of the rubber are enumerated below: Ethylene-propylene-diene copolymer rubber (EPDM), acrylonitrile-butadiene copolymer rubber (NBR), chloroprene rubber (CR), natural rubber (NR), isoprene rubber (IR), styrene-butadiene rubber (SBR), fluororubber, silicone rubber, epichlorohydrin rubber, hydrogenated products of NBR, and urethane rubbers.

These rubbers may be used in a combination of two or more types as needed inasmuch as they can provide the desired hardness of the elastic-material layer and the properties required for the developing roller.

Various additives may also optionally be mixed in these rubbers to form the elastic-material layer. Such additives include components necessary for the function required for the elastic-material layer itself, such as a conductive agent and non-conductive filler, and various additive components used when a rubber molded product is formed, such as a cross-linking agent, a catalyst and a dispersing agent.

Specific examples of the conductive agent usable for imparting electrical conductivity to the elastic-material layer are enumerated below:

Carbon black, graphite (GF), and metals or alloys, such as aluminum, copper, tin and stainless steel; conductive metal oxides such as tin oxide, zinc oxide, indium oxide, titanium oxide, a tin oxide-antimony oxide solid solution and a tin oxide-indium oxide solid solution; and fine powders of insulating materials coated with any of the above metals, alloys and metal oxides.

Of these, carbon black is preferred because it is relatively easily available and can achieve good electrical conductivity without regard to types of chief-component rubber.

When carbon black is used for making the elastic-material layer electrically conductive, it preferably has DBP absorption in the range of 50 ml/100 g or more and 110 ml/100 g or less. The use of the carbon black having DBP absorption in this range can keep the hardness of the elastic-material layer relatively low and make it easy to achieve the desired electrical conductivity.

Specifically, the carbon black having a DBP absorption of 50 ml/100 q or more can be easily dispersed into the elastic-material layer and also can control the quantity to be added for achieving the electrical conductivity. When the carbon black having a DBP absorption of 110 ml/100 g or less is used, the effect of reinforcing the elastic-material layer is not large, and the hardness is not increased more than necessary, making it easy for the elastic-material layer to stably have the preferable hardness and desired electrical conductivity. It is more preferable that the DBP absorption of carbon black is in the range of 60 ml/100 g or more and 100 ml/100 g or less.

The DBP absorption of carbon black shows the absorption of DBP per 100 g of the carbon black, and is one of indexes by which the size of the structure of carbon black is judged. The structure of carbon black is formed by chain connection of unit particles of carbon black, and its size influences the electrical conductivity of carbon black when mixed in rubber. In the present invention, the DBP absorption is measured according to JIS K 6217-4. Such carbon black may be any of commercially available products, products obtained by treating commercially available products and newly produced products, as long as they have the above properties. The carbon black may include oil furnace black, gas furnace black, channel type carbon black, and carbon black obtained by subjecting any of these carbon blacks to oxidation treatment.

It is preferable that the carbon black is normally added in an amount of 10 parts by mass or more and 80 parts by mass or less based on 100 parts by mass of the rubber that forms the elastic-material layer. When added in an amount of 10 parts by mass or more, the desired electrical conductivity is easy to stably achieve. When added in an amount of 80 parts by mass or less, the hardness is by no means made too high. Further, in the respect that carbon black is easily dispersed into the elastic-material layer and can stably achieve the desired electrical conductivity, it is more preferable that the amount of carbon black to be added is 20 parts by mass or more and 50 parts by mass or less.

Means for dispersing such finely powdered conductive agent in the main-component rubber include conventionally used means, i.e., methods using apparatuses such as a roll kneader, a Banbury mixer, a ball mill, a sand grinder and a paint shaker. These may be used under appropriate selection according to the main-component rubber materials.

As another method for imparting electrical conductivity to the elastic-material layer, a method may be used in which a conductive polymeric compound is added alone or together with the conductive agent. Compounds obtained by doping host polymers with various types of dopants may be used as the conductive polymeric compound.

Examples of the host polymers are enumerated below: Polyacetylene, poly(p-phenylene), polypyrrole, polythiophene, poly(p-phenylene oxide), poly(p-phenylene sulfide), poly(p-phenylene vinylene), poly(2,6-diemthylphenylene oxide), poly(bisphenol A carbonate), polyvinyl carbazole, polydiacetylene, poly(N-methyl-4-vinylpyridine), polyaniline, polyquinoline, poly(phenylene ether sulfone) and so forth.

Examples of dopants are enumerated below: $AsF_5$, $I_2$, $Br_2$, $SO_3$, Na, K, $ClO_4$, $FeCl_3$, F, Cl, Br, I, Kr, $L_1$, and 7,7,8,8-tetracyanoquinodimethane (TCNQ).

The non-conductive filler that may be added to the elastic-material layer includes diatomaceous earth, quartz powder, dry-process silica, wet-process silica, titanium oxide, zinc oxide, aluminum silicate, and calcium carbonate.

Examples of the cross-linking agent used when the elastic-material layer is formed are enumerated below: Organic peroxides, sulfur, sulfur compounds, sulfur-containing organic vulcanizing agents, triazine compounds and so forth.

Where an organic peroxide is used as a vulcanizing agent, a co-cross-linking agent may be mixed and used in combination with the organic peroxide. Examples of such a co-cross-linking agent are enumerated below:

Sulfur, p-quinone dioxime, p-benzoquinone dioxime, p,p'-dibenzoylquinone dioxime, N-methyl-N'-4-dinitroaniline, N-N'-m-phenylene dimaleimide, dipentamethylenethiuram pentasulfide, dinitrobenzene, divinylbenzene, triallyl cyanurate, triallyl isocyanurate, triazinethiol, ethylene glycol dimethacrylate, diethylene glycol dimethacrylate, triethylene glycol dimethacrylate, polyethylene glycol dimethacrylate, neopentyl glycol dimethacrylate, dipropylene glycol dimethacrylate, trimethylolpropane triacrylate, erythritol tetramethacrylate, trimethylolpropane trimethacrylate, diallylmelamine, trimethacrylate, dimethacrylate, divinyl adipate, vinyl butyrate, vinyl stearate, liquid polybutadiene rubber, liquid polyisoprene rubber, liquid styrene-butadiene rubber, liquid acrylonitrile-butadiene rubber, magnesium diacrylate, calcium diacrylate, aluminum acrylate, zinc acrylate, stannous acrylate, zinc methacrylate, magnesium methacrylate, and zinc dimethacrylate.

Any of these co-cross-linking agents may be used alone or in a combination of two or more types.

Where a sulfur type vulcanizing agent is used as the vulcanizing agent, a vulcanization accelerator may be used. Examples of such a vulcanization accelerator are enumerated below:

Aldehyde ammonias such as hexamethylenetetramine, and acetaldehyde ammonia; aldehyde amines such as a n-butyl aldehyde aniline condensation product, a butyl aldehyde monobutylamine condensation product, a heptaldehyde aniline condensation product and a tricrotonilidene tetramine condensation product; guanidine salts such as diphenylguanidine, di-o-tolylguanidine, o-tolyl biguanide, and a di-o-tolyl guanidine salt of dicatechol boric acid; imidazolines such as 2-mercaptoimidazoline; thiazoles such as 2-mercaptobenzothiazole, 2-mercaptothiazoline, dibenzothiazyl disulfide, a zinc salt of 2-mercaptobenzothiazole, a sodium salt of 2-mercaptobenzothiazole, a cyclohexylamine salt of 2-mercaptobenzothiazole, 2-(2,4-dinitrophenylthio)benzo-thiazole, 2-(N,N-diethylthiocarbamoylthio)benzothiazole, 2-(4'-morpholinodithio)benzothiazole, 4-morpholino-2-benzothiazyl disulfide; sulphenamides such as N-cyclohexyl-2-benzothiazole sulphenamide, N,N-dicyclohexyl-2-benzothiazole sulphenamide, N-oxydiethylene-2-benzothiazyl sulphenamide, N,N-diisopropyl-2-benzothiazyl sulphenamide, and N-t-butyl-2-benzothiazyl sulphenamide; thioureas such as thiocarbanide, ethylene thiourea(2-mercaptoimidazoline), diethylthiourea, dibutylthiourea, mixed alkylthioureas, trimethylthiourea, and dilaurylthiourea; dithiocarbamates such as sodium dimethyl dithiocarbamate, sodium diethyl dithiocarbamate, sodium di-n-butyl carbamate, lead dimethyl dithiocarbamate, lead diamyl dithiocarbamate, zinc diamyl dithiocarbamate, zinc diethyl dithiocarbamate, zinc di-n-butyl dithiocarbamate, zinc dibenzyl dithiocarbamate, zinc N-pentamethylene dithiocarbamate, zinc ethylphenyl dithiocarbamate, selenium dimethyl dithiocarbamate, selenium diethyl dithiocarbamate, tellurium diethyl dithiocarbamate, cadmium diethyl dithiocarbamate, copper dimethyl dithiocarbamate, iron dimethyl dithiocarbamate, bismuth dimethyl dithiocarbamate, piperidine dimethyl dithiocarbamate, pipecoline methylpentamethylene dithiocarbamate, and activated dithiocarbamate; thiurams such as tetramethylthiuram monosulfide, tetramethylthiuram disulfide, activated tetramethylthiuram disulfide, tetraethylthiuram disulfide, tetrabutylthiuram disulfide, N,N'-dimethyl-N,N'-diphenylthiuram disulfide, dipentamethylenethiuram disulfide, dipentamethylenethiuram tetrasulfide, and mixed alkylthiuram disulfides; xanthates such as sodium isopropyl xanthate, zinc isopropyl xanthate, and zinc butyl xanthate; 4,4'-dithiodimorpholine, aminodialkyl dithiophosphates, zinc o,o-n-butyl phosphorodithioate, 3-mercaptoimidazoline-thione-2, and thioglycol ester; and so forth.

Any of these vulcanization accelerators may be used alone or in a combination of two or more types.

In addition to the above vulcanizing agents and vulcanization accelerators, a vulcanization accelerating auxiliary may optionally be added. Such a vulcanization accelerating auxiliary is enumerated below: Metal oxides such as magnesium oxide, zinc white, activated zinc white, surface-treated zinc white, zinc carbonate, composite zinc white, composite activated zinc white, surface-treated magnesium oxide, calcium hydroxide, ultrafine calcium hydroxide, lead monoxide, lead (II) oxide (litharge), red lead, and white lead; and organic acids (salts) such as stearic acid, oleic acid, lauric acid, zinc stearate, calcium stearate, potassium stearate, and sodium stearate. In particular, zinc white, stearic acid and zinc stearate are preferred.

Any of these vulcanization accelerating aids may be used alone or in a combination of two or more types.

In the case of a liquid silicone rubber, it may preferably be a rubber having been cross-linked by using a curable organopolysiloxane and a curing agent having a siloxane skeleton.

As the curable organopolysiloxane, the following is usable: e.g., dimethyl polysiloxane or an organopolysiloxane having at its terminal a functional group capable of reacting with a curing agent, such as a vinyl group. The curable organopolysiloxane is a base polymer of silicone rubber raw materials, and may preferably have a molecular weight of, but not particularly limited to, 100,000 or more from 1,000,000 or less, and may preferably have an average molecular weight of about 500,000.

An organohydrogenpolysiloxane may be used as the curing agent. An alkenyl group of the curable organopolysiloxane is a moiety capable of reacting with active hydrogen of the curing agent organohydrogenpolysiloxane to form a cross-linked point There are no particular limitations on such an alkenyl group, but, for the reason of, e.g., high reactivity with the active hydrogen, the alkenyl group is preferably at least one of a vinyl group and an allyl group, and a vinyl group is particularly preferred. The organohydrogenpolysiloxane is a polymer which functions as a cross-linking agent of the addition reaction in the step of curing, and has two or more hydrogen atoms bonded to the silicon atom in one molecule. In order to effect the curing reaction in an optimum condition, a polymer is preferable having three or more hydrogen atoms. There are no particular limitations on the molecular weight of the organohydrogenpolysiloxane, which may include those of from a low molecular weight to a high molecular weight. However, in order to effect the curing reaction in an optimum condition, polymers are preferable having a relatively low molecular weight.

In the present invention, in place of chloroplatinic hexahydrate used as a cross-linking catalyst of the organohydrogenpolysiloxane, a transition metal compound may be used which shows catalytic action in the hydrosilylation reaction. The cross-linking catalyst may include, but is not particularly limited to, the following: $Fe(CO)_5$, $Co(CO)_8$, $RuCl_3$, $IrCl_3$, $[(olefin)PtCl_2]_2$, a vinyl group-containing polysiloxane Pt complex, $H_2PtCl_6.6H_2O$, $L_3RhCl_3$, $L_2Ni(olefin)$, $L_4Pd$, $L_4Pt$ and $L_2NiCl_2$ (where L is $PPh_3$ or $PR'_3$, where Ph represents a phenyl group, and R' represents an alkyl group). In particular, platinum, palladium or rhodium type transition metal compound catalysts are preferable.

The elastic-material layer may preferably have a thickness of 0.5 mm or more, and particularly 1.0 mm or more, in order to secure a uniform nip width when coming into contact with the photosensitive drum and also satisfy preferable set recovery properties. There are no particular limitations on the thickness of the elastic-material layer as long as the precision of outer diameter of the developing roller to be produced is not impaired. In general, however, an elastic-material layer having an excessively large thickness makes it difficult to control production costs within a proper range and makes it difficult to stabilize the dimensional precision of the developing roller itself. Taking these practical restrictions into account, the elastic-material layer may preferably have a thickness of 5.0 mm or less, and particularly 4.0 mm or less. That is, the elastic-material layer may preferably have thickness within the range of 0.5 mm or more and 5.0 mm or less, and particularly from 1.0 mm or more to 4.0 mm or less. Then, the thickness of the elastic-material layer may appropriately be determined within the above range in accordance with its hardness.

The elastic-material layer may be formed by any method such as extrusion or cast molding. Depending on the types of materials used to form the elastic-material layer, the elastic-material layer may be subjected to modification treatment on its peripheral surface before the cover layer is superposed thereon. Such modification treatment may include corona treatment, plasma treatment, low-pressure mercury UV treatment and excimer UV treatment.

<Cover Layer (Surface Layer)>

The developing roller of the present invention has the cover layer (surface layer) 13 on the peripheral surface of the elastic-material layer 12.

<Regarding Requirements (b) and (c)>

The cover layer is required to fulfill the requirements (b) and (c) mentioned above.

The technical significance of the requirements (b) and (c) is explained below.

First, the requirement (c) is to specify the hardness of the cover layer per unit thickness (1 mm).

In the present invention, the Martens hardness is the value of physical properties according to IS014577 that is found when an indenter is pushed into an object to be measured while applying a load to the indenter. It is found according to the following expression:

(Test load)/(surface area of indenter under test load) ($N/mm^2$).

The Martens hardness may be measured with an ultra-microhardness test system (trade name: PICODENTER HM500; manufactured by Fischer Instruments KK). In this measuring instrument, an indenter having a given shape is pushed into an object to be measured while applying a given relatively small load to the indenter. At a point of time that the indenter has reached a predetermined indentation depth, the area of the surface with which the indenter is in contact is determined from the indentation depth, and the Martens hardness is found according to the above expression. That is, the stress produced with respect to the depth of indentation when the indenter is pushed into the object to be measured under constant-load measuring conditions is defined as the Martens hardness.

In the present invention, a quadrangular pyramid indenter is pushed into the developing roller surface at a constant load application rate (1 $mN/mm^2$/sec.) in the direction vertical from the surface until reaching a depth of 0.80 μm, to thereby measure the Martens hardness. The measurement is made at three spots which are positions set by dividing the developing roller into four equal parts in its lengthwise direction, and the value found as an arithmetic means of the measurements is defined as the Martens hardness H1 ($N/mm^2$).

The Martens hardness H2 of the elastic-material layer is measured at the cut surfaces of the elastic-material layer of the developing roller cut at the planes each of which passes along straight lines connecting two points adjoining to each other when the peripheral surface of the developing roller is divided into six equal parts in its peripheral direction (a chord of an arc corresponding to ⅙ of the outer circumference) and are parallel to the axis of the mandrel.

The measurement of the Martens hardness H2 of the elastic-material layer may be made in the same way as in the measurement of the Martens hardness of the developing roller surface. The measurement is made at three spots which are positions set by dividing the developing roller into four equal parts in its lengthwise direction, and the value found as an arithmetic means of the measurements is defined as the Martens hardness H2 ($N/mm^2$).

The difference between the Martens hardness H1 and the Martens hardness H2 which are measured in this way is divided by the thickness of the cover layer, thus the hardness of the cover layer per unit thickness is determined. The reason why the hardness of the cover layer is defined in this way is that the cover layer is as thin as 15 nm or more and 5,000 nm or less. More specifically, where such a thin cover layer is present on the surface of the elastic-material layer, it is very difficult with state of the art to measure directly and accurately the hardness peculiar to that cover layer. Accordingly, the hardness as a laminate formed of the elastic-material layer and the cover layer and the hardness of the elastic-material layer are each measured and the difference between them is taken, which is thus defined as the hardness peculiar to the cover layer.

In the developing roller, when the value of (H1−H2)/d is set to be 400 or more, on condition that the thickness of the cover layer is in the range of 15 nm or more and 5,000 nm or less, the partial permanent set can be inhibited from occurring in the developing roller.

The reason why such partial permanent set can be inhibited from occurring is unclear, but may be presumed as follows.

That is, the cover layer is relatively hard so that the cover layer itself can not easily be deformed, and also has appropriate flexibility. The cover layer itself can be bent as a film, but cannot easily be caused such deformation as to result in local and abrupt bending or to reduce the thickness. The cover layer itself disperses into its interior, and transmits to the under layer which is the elastic-material layer, the force the cover layer receives when coming into contact with the contact member. The contact member(s) may be kept in contact with the developing roller at its specific portion over a long period of time and thereafter the developing roller may be released from such contact, when the elastic-material layer can sufficiently be recovered from its deformation as being low in hardness and excellent in recovery from deformation. At the same time, the cover layer itself as well returns to its original shape following the recovery of the elastic-material layer. That is, the cover layer not only inhibits the good deformation recovery properties the elastic-material layer has, but also diffuses the stress into the elastic-material layer to make the deformation recovery properties of the elastic-material layer more excellent.

In the developing roller, when the value of (H1−H2)/d is set to be 2,000 or less, on condition that the thickness of the cover layer is in the range of 15 nm or more and 5,000 nm or less, the developing roller has flexibility to keep toner form deteriorating. The cover layer is required to have a thickness of 15 nm or more and 5,000 nm or less.

As long as the cover layer has a thickness of 15 nm or more, the cover layer can stably be formed which has the Martens hardness satisfying the relationship of the expression (1). As long as the cover layer has a thickness of 5,000 nm or less, the cover layer can keep itself from substantially affecting the Asker-C hardness of the developing roller In addition, as long as the cover layer having the Martens hardness satisfying the relationship of the expression (1) has a thickness of 5,000 nm or less, the developing roller can easily have Asker-C hardness of 850 or less, and can keep toner form deteriorating.

Regarding specific configuration and production process of cover layer:

Specific examples of a component(s) which form(s) the cover layer 13 are enumerated below:

Polyamide resins, urethane resins, urea resins, epoxy resins, acrylic resins, fluorine resins, polyimide resins, polyethylene resins, polypropylene resins, and polystyrene resins; silica type materials such as $SiO_x$; diamond-like carbon (herein also "DLC"); and so forth.

Any of these materials may be used alone or in the form of a mixture of two or more types.

Of these, fluorine resins, polyimide resins, silica type materials (such as $SiO_x$) and DLC are preferred, as having superior mechanical properties.

As the fluorine resins, commonly available polymers containing fluorine may be used, such as polytetrafluoroethylene, polyvinylidene fluoride, and a tetrafluoroethylene-hexafluoropropylene copolymer.

The fluorine resins may include the following materials: Polytetrafluoroethylene, polychlorotrifluoroethylene, polyvinylidene fluoride, and tetrafluoroethylene and copolymers thereof with at least one of other ethylenically unsaturated monomers. The ethylenically unsaturated monomer includes as specific examples the following: Olefins such as ethylene and propylene, halogenated olefins such as hexafluoropropylene, vinylidene fluoride, chlorotrifluoroethylene and vinyl fluoride, perfluoroalkyl vinyl ethers, and so forth.

Where a solvent-soluble fluorine resin is used, the concentration of a solution of the fluorine resin may be controlled, thus a cover layer of the fluorine resin having the desired thickness can be formed relatively easily by using a wet process described later. Such a solvent-soluble fluorine resin includes the following:

Vinylidene fluoride; and vinylidene fluoride copolymers such as a copolymer of tetrafluoroethylene and hexafluoropropylene;

copolymers of fluoroolefins such as tetrafluoroethylene and chlorotrifluoroethylene and hydrocarbon type olefins such as vinyl ether, vinyl ester and vinyl silane;

copolymers of fluoroacrylate and acrylate; and polymers of diepoxy compounds substituted with perfluoroalkyl groups.

Any of these resins may be used alone as a resin component, or may be used in the form of a mixture with other resin(s).

The polyimide resins may be either aromatic polyimides or alicyclic polyimides as long as they are polymers having cyclic imide structures in the backbone chain. More specific polyimide resin materials includes, e.g., thermosetting resins such as polypyromellitic acid imide type polyimide resin materials and polybiphenyltetracarboxylic acid imide type resin materials.

The $SiO_x$ included in the cover layer includes the following: Silicon oxide type materials having a structure which has oxygen-silicon-oxygen as a main skeleton and has a silicon-carbon bond and in which two of at least one of hydrogen, oxygen and carbon are bonded to the silicon.

The DLC is a generic term of carbon thin films similar to diamonds and having high hardness, electrical insulating properties and ultraviolet light transmitting properties. Specifically, the DLC means a material composed chiefly of carbon, contains hydrogen in a small amount, and has an amorphous structure in which both of diamond bonds ($SP^3$ bonds) and graphite bonds ($SP^2$ bonds) are mixed.

The cover layer described above is formed on the elastic-material layer 12 by a wet process or a dry process such as vacuum deposition, physical vapor deposition (PVD) process or chemical vapor deposition (CVD) process. The wet process include as specific examples dip coating, spray coating and roll coating. The PVD process includes as specific examples sputtering and ion plating. The CVD process includes as specific examples plasma CVD, thermal CVD and laser CVD.

Solvents for preparing solutions used in dip coating, spray coating and roll coating may be selected from those capable of dissolving materials for the cover layer to be formed. Usually, lower alcohols are preferably used such as methanol, ethanol and isopropanol; ketones such as acetone, methyl ethyl ketone and cyclohexanone; and toluene, xylene, N-methylpyrrolidone, and N,N-dimethylacetamide.

In the present invention, it is particularly preferable for the cover layer to be formed by using a material composed chiefly of $SiO_x$. This is because the above requirements (b) and (c) can easily be controlled. The cover layer composed chiefly of $SiO_x$ can preferably be formed by plasma CVD, because the cover layer can be formed in more uniform composition and layer thickness. More specifically, the plasma CVD is a process in which, in a chamber in which an elastic roller has been placed between a pair of electrodes, an organosilicon compound is fed as a raw-material gas together with necessary hydrocarbon compounds, oxygen gas and so forth, and high-frequency electric power is supplied across the electrodes to cause plasma to take place to form an $SiO_x$ film on an elastic layer of the elastic roller. The organosilicon compound includes as specific examples hexamethyldisiloxane and 1,1,3,3-tetramethyldisiloxane. The hydrocarbon compound includes as specific examples toluene, xylene, methane, ethane, propane and acetylene.

Where the $SiO_x$ film formed by plasma CVD serves as the cover layer, its hardness may be controlled by the abundance ratio of silicon atoms in the $SiO_x$ film and oxygen atoms bonded chemically to the silicon atoms. Specifically, the $SiO_x$ film becomes harder with an increase in the abundance ratio of oxygen atoms bonded chemically to silicon atoms to the silicon atoms, O/Si, in other words, as coming close to $SiO_2$. More specifically, the value of [(H1−H2)/d] can be made larger. On the other hand, the $SiO_x$ film becomes softer as the O/Si is made lower. More specifically, the value of [(H1−H2)/d] can be made smaller.

The O/Si may be controlled by the mixing ratio or the like of raw-material gases. For example, the value of O/Si can be made larger by increasing the proportion of oxygen gas in the ratio of mixing the organosilicon compound and oxygen gas. In addition, the value of O/Si can be made smaller by increasing the high-frequency electric power.

Where the $SiO_x$ film is formed by plasma CVD on the elastic-material layer containing a silicone rubber, an $SiO_x$ film having the O/Si in the range of 1.00 or more and 1.80 or less can fulfills the requirement (c) on condition that it fulfills the requirement (b).

The abundance ratio of the elements in the cover layer formed of the $SiO_x$ film may be determined in the following way.

Using an X-ray photoelectron spectrometer (trade name: QUANTUM 2000; manufactured by Ulvac-Phi, Inc.), the surface of the surface layer (cover layer) 13 of the developing roller is irradiated with AlKα from an X-ray source to measure peaks due to bond energies of the 2p orbital of Si and the 1s orbital of O. The abundance ratio of each of the atoms is calculated from each of the peaks, and based on the abundance ratios, the value of O/Si is found.

<Regarding Requirement (a)>

The developing roller having the cover layer thus formed is required to have Asker-C hardness measured at the surface of the developing roller in the range of 40° or more and 85° or less. This is to keep toners from deteriorating and to secure the nip width between the developing roller and the electrophotographic photosensitive drum.

Here, the Asker-C hardness of the developing roller surface is substantially the value influenced by the thicknesses of the elastic-material layer and cover layer. The same tendency as in the above is shown also where the elastic-material layer is formed from the same material, the layer thickness is thin and the Asker-C hardness is high. This is because the measured value is reflected by the hardness of the mandrel in a case in which the thickness of the elastic-material layer is thin. In either case, as long as the measured value of the Asker-C hardness at the surface of the cover layer is in the above range, it follows that the requirement (a) is fulfilled in the developing roller of the present invention.

In the present invention, the hardness of the cover layer is substantially set to be higher than the elastic-material layer. However, as the thickness of the cover layer is within the range described above, the Asker-C hardness of the developing roller surface is substantially controlled by the Asker-C hardness of the elastic-material layer. As long as the developing roller fulfills the requirement (a), the Asker-C hardness of the roller surface on which the elastic-material layer is present with the cover layer having not been formed thereon may preferably be within the range of 25° or more and 82° or less.

<Contact Angle to Diiodomethane>

In the present invention, the developing roller surface may preferably have a contact angle to diiodomethane in the range of 40° or more and 70° or less, and more preferably 50° or more and 65° or less. Inasmuch as the contact angle to diiodomethane is 40° or more, the adhesion of an external additive(s) which is/are a constituent(s) of toner or toner itself can be kept low. Inasmuch as the contact angle to diiodomethane is 70° or less, toner can stably be held on the surface of the developing roller. That is, sufficient image density can be achieved when images are formed.

The reason why the external additive(s) and the toner are inhibited from adhering when controlling the contact angle of the developing roller surface to diiodomethane, is presumed as below. Such adhesion of the external additive(s) or toner is what can physically be removed. Where the cover layer 13 in the present invention is formed of an inorganic film, the adhesion of the external additive(s) or toner is predominantly caused by the van der Waals force. In such a case, the control of the contact angle to diiodomethane containing no hydrogen bond component is concerned with the prevention of the adhesion of the external additive(s) or toner.

The hydrogen bond component is one factor that constitutes the surface free energy (γTotal), and is defined in the following way. That is, the surface free energy (γTotal) is considered to be classified into three components: a dispersion force component (γd), an orientation force component (polar component) (γp) and a hydrogen bond force component (γh), and can be represented by the following expression:

$$\gamma\text{Total}=\gamma d+\gamma p+\gamma h$$

In the above expression, γd represents dispersion force (induced bipole interaction) component; γp, orientation force (polar molecule interaction) component; and γh, hydrogen bond force (hydrogen atom/negative atom interaction) component.

This analysis is based on the Kitazaki-Hata theory, and is specifically described in an article of Hata et al. (J. Adhesion, 21, 177, (1987)).

In the developing roller, the value of the contact angle to diiodomethane and the surface free energy (γTotal) do not necessarily have the relationship of inverse proportion. However, when controlling the contact angle of the surface to diiodomethane, the effect of reducing attachments can be obtained.

It is further preferable for the developing roller of the present invention that the developing roller surface has a surface free energy of 20 $mJ/m^2$ or more and 40 $mJ/m^2$ or less and also the surface free energy has a dispersion force component of from 10 $mJ/m^2$ or more to 25 $mJ/m^2$ or less. Inasmuch as these values are within these ranges, the external additive(s) or the toner can be further kept from adhering to the roller surface, and at the same time, the necessary toner transport performance can be easily achieved.

<Regarding Break at 5% Stretch Deformation>

In the developing roller of the present invention, it is preferable that when a strip specimen cut out of the developing roller, including the cover layer and the elastic-material layer, is subjected to 5% stretch deformation, no break occurs in the cover layer. Inasmuch as the cover layer has such a feature, the components contained in the elastic-material layer can not easily exuding onto the developing roller surface, and toner or its external additive(s) can be kept from adhering to the developing roller surface.

In the foregoing, the developing roller having a double-layer structure is described having the mandrel 11, the elastic-material layer 12 and the cover layer 13 in this order provided on the peripheral surface of the mandrel. The developing roller of the present invention may also have a triple or more, multi-layer structure in respect of the layers to be formed on the peripheral surface of the mandrel. Such a developing roller includes, e.g., a developing roller in which the elastic-material layer 12 itself is composed of a plurality of layers. In such a case, the Martens hardness H2 ($N/mm^2$) of the elastic-material layer positioned on the outermost side can be used as the Martens hardness H2 ($N/mm^2$) in the expression (1).

As described above, the developing roller of the present invention has low hardness and good deformation recovery properties, keeping the photosensitive drum from being contaminated and concurrently having the surface properties such that toner or external additives thereof do not easily adhere. Because of these advantages, when used as a developing roller of a developing assembly, process cartridge or electrophotographic image forming apparatus, image density non-uniformity and density decrease can be kept from occurring even in repeated image reproduction on a large number of sheets. In addition, image lines due to toner melt adhesion to a control member are inhibited from occurring, and good images can be continuously obtained. Further, the electrographic image forming apparatus itself to be used can be made high-speed, where the above advantages can be more remarkable under such conditions that the process speed, i.e., the surface speed of the photosensitive drum is made higher.

<Developing Assembly, Electrographic Process Cartridge and Electrophotographic Image Forming Apparatus>

The developing assembly, electrographic process cartridge and electrophotographic image forming apparatus according to the present invention are described below.

The developing assembly according to the present invention has a developing roller which holds a toner thereon in the state of facing a latent image bearing member which holds an electrostatic latent image thereon, and a control blade which controls the layer thickness of toner while triboelectrically charging the toner held on the developing roller. The developing assembly is one in which the developing roller provides the latent image bearing member with toner to render the electrostatic latent image visible into a toner image, and is characterized in that the developing roller is the above developing roller of the present invention.

The electrographic process cartridge according to the present invention has a latent image bearing member, a charging assembly which charges the surface of the latent image bearing member, and a developing assembly which develops an electrostatic latent image formed on the latent image bearing member, and is characterized in that the developing assembly is the above developing assembly of the present invention.

The electrophotographic image forming apparatus according to the present invention has a latent image bearing member on which an electrostatic latent image is formed by an electrographic system, a charging assembly which is to charge the surface of the latent image bearing member in a charge quantity necessary to form the electrostatic latent image, and an electrostatic latent image forming assembly which is to form the electrostatic latent image in a charged region of the latent image bearing member. The electrophotographic image forming apparatus further has a developing assembly which applies toner to the electrostatic latent image formed by the electrostatic latent image forming assembly to render the electrostatic latent image visible as a toner image, and a transfer assembly which is to transfer the toner image to a transfer material. Then, the electrographic image forming apparatus of the present invention is characterized in that the developing assembly is the above developing assembly of the present invention.

Figure 3:
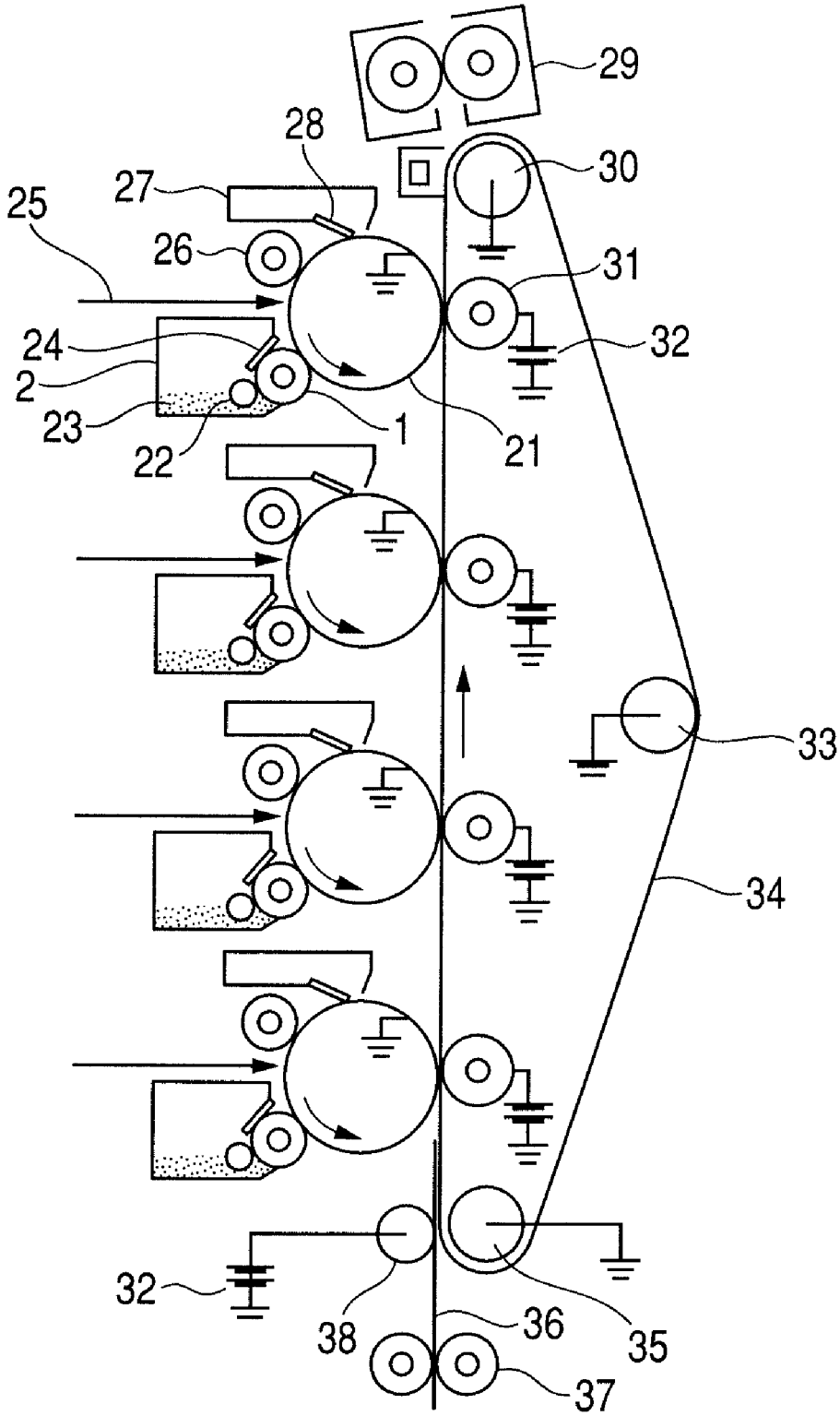
FIG. 3 is a schematic structural view showing an example of an electrographic image forming apparatus using a developing assembly of the present invention.

FIG. 3 is a sectional view schematically showing the structure of an example of an electrographic image forming apparatus having developing assemblies each having the developing roller according to the present invention. The electrographic image forming apparatus shown in FIG. 3 has, in each image forming unit, a photosensitive drum 21 as the latent image bearing member on which an electrostatic latent image is formed by an electrographic system, and a charging member 26 as the charging assembly which is to charge the surface of the latent image bearing member in a charge quantity necessary to form the electrostatic latent image.

Each image forming unit also has the electrostatic latent image forming assembly (not shown) which is to form the electrostatic latent image in a charged region of the latent image bearing member, and a developing assembly 2 which applies toner to the electrostatic latent image to render the electrostatic latent image visible as a toner image (an image formed from toner), and further has a transfer roller 31 as the transfer assembly which is to transfer the toner image to a transfer sheet as the transfer material. Then, the image forming apparatus shown in FIG. 3 has the developing assembly of the present invention as the developing assembly 2.

In the electrographic image forming apparatus shown in FIG. 3, each photosensitive drum 21 is rotated in the direction of an arrow, and is uniformly charged by means of the charging member 26, which is to charge the photosensitive drum 21. The photosensitive drum 21 is exposed to laser light 25, an exposure means of the electrostatic latent image forming assembly, which is to write electrostatic latent images to the photosensitive drum 21, to form the electrostatic latent images on the surface of the photosensitive drum 21. The electrostatic latent images thus formed by the laser light 25 are provided with a developer by means of the developing assembly 2 placed in contact with the photosensitive drum 21, so that the latent images are developed and rendered visible as toner images. The development is performed by what is called the reverse development that forms the toner images at exposed areas. The toner images on the photosensitive drum 21 which have been formed by rendering the latent images visible are transferred to a transfer sheet 36 by means of the transfer roller 31. The transfer sheet 36 to which the toner images have been transferred is fixed by means of a fixing assembly 29, and then delivered out of the apparatus, thus the operation of printing is completed.

A transfer residual toner remaining on the photosensitive drum 21 without being transferred is scraped off with a cleaning blade 28 which is to clean the photosensitive drum 21 surface. The transfer residual toner having been scraped off is collected in a waste toner container 27. On the photosensitive drum 21 thus cleaned, the above operation is repeated.

The developing assembly 2 has a developing roller 1 which holds the toner thereon in the state of facing the photosensitive drum 21 serving as the latent image bearing member which holds the electrostatic latent images thereon, and a control blade 24 which controls the layer thickness of toner while triboelectrically charging the toner held on the developing roller 1. In the developing assembly 2, the developing roller 1 provide the latent image bearing member photosensitive drum 21 with the toner to render the electrostatic latent images visible as toner images, to form images composed of the toner (toner images). Each developing assembly 2 shown in FIG. 3 has a developer container holding a non-magnetic toner 23 as a one-component developer, and the developing roller 1 as the developing roller according to the present invention, which is positioned at an opening extending in the lengthwise direction inside the developer container. The control blade 24 is also provided along an upper edge of the opening extending in the lengthwise direction of the developer container.

In FIG. 3, reference numeral 34 denotes a transfer transport belt which transports the transfer sheet 36. Reference numerals 30, 33 and 35 denote a drive roller, a tension roller and a follower roller, respectively, which are used to rotate the transfer transport belt 34. Reference numeral 32 denotes a bias power source. Further, reference numeral 37 denotes a paper feed roller which feeds the transfer sheet 36 from a paper feed cassette (not shown) Reference numeral 38 denotes an adsorption roller for electrostatically adsorbing the transfer sheet 36 fed by the paper feed roller 37 so as to be held on the transfer transport belt.

Figure 4:
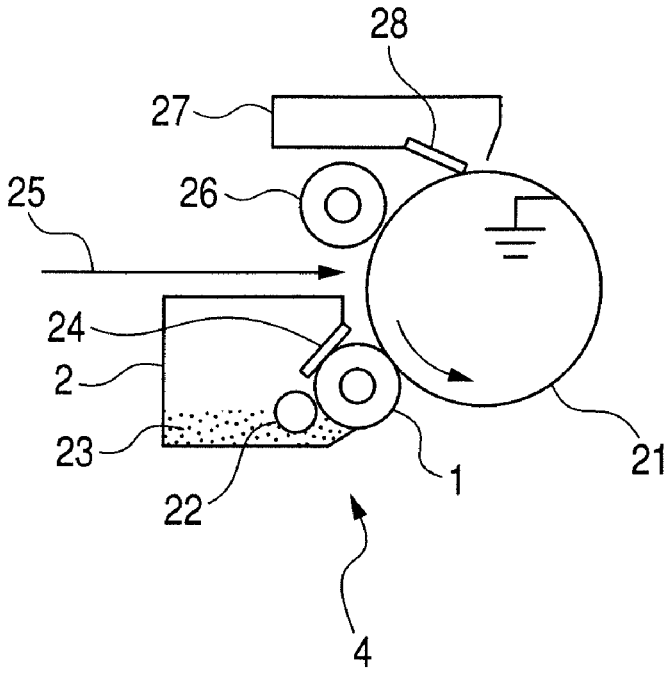
FIG. 4 is a schematic structural view showing an example of an embodiment of a process cartridge of the present invention.

An example of an embodiment of the electrophotographic process cartridge according to the present invention is illustrated in FIG. 4. The process cartridge shown in FIG. 4 has a photosensitive drum 21 as a latent image bearing member, a charging member 26 as a charging assembly which uniformly charges the surface of the photosensitive drum 21, and a developing assembly 2 of the present invention as a developing assembly which develops an electrostatic latent image formed on the photosensitive drum 21. The electrographic process cartridge of the present invention may further have at least one of a cleaning member 28 and a transfer roller 31.

The process cartridge of the present invention has the above members which are integrally held together, and is detachably mountable on the main body of the image forming apparatus. When image formation is carried out, the developing roller 1 is kept in contact with the photosensitive drum 21 in a certain contact width. In the developing assembly 2, a toner coating member 22 is, inside a developer container, kept in contact with the developing roller 1 on the upstream side in the rotational direction with respect to the contact part at which a control blade 24 which is a toner layer thickness control member is brought into contact with the surface of the developing roller 1, and is supported in a rotatable state.

The toner coating member 22 may be so structured as to have a foamed skeletal spongy structure or a fur brush structure in which fibers such as rayon or polyamide fibers have been set on a mandrel Such a member is preferred in view of the feeding of toner 23 to, and the scraping of toner not participated in development off, the developing roller 1. Specifically, for example, an elastic roller 16 mm in diameter having a mandrel and a polyurethane foam provided thereon may be used as the toner coating member 22. This toner coating member 22 is in contact with the developing roller 1 preferably in a contact width of from 1 mm to 8 mm, and also preferably has a relative speed at the contact part between them.

EXAMPLES

Working examples (Examples) are given below to describe the present invention in greater detail. Description is performed here taking examples of the developing roller having the mandrel, and the elastic-material layer and the cover layer in this order provided on the peripheral surface thereof as described above. These Examples are the best embodiments of the present invention, but the present invention is by no means limited by these Examples. The developing rollers produced by methods shown in Examples are preferably usable as developing rollers used in electrographic image forming apparatus.

In the present Examples, the layer thickness of the cover layer, the Asker-C hardness, the Martens hardness, the contact angle, the surface free energy, the dispersion force component of the surface free energy and the DBP absorption of carbon black were measured by the following methods.

<Layer Thickness of Cover Layer>

The layer thickness of the cover layer was measured with a thin-film measuring instrument F20-EXR (trade name; manufactured by Film Metrics Co.). The layer thickness is obtained by measurement at three points each set dividedly at intervals of 1200 in its peripheral direction for each of three spots which are positions set by dividing the developing roller into four equal parts in its lengthwise direction, at nine points in total, and is the value found as an arithmetic means of the measurements.

<Asker-C Hardness>

The Asker-C hardness in the present invention refers to the hardness of the developing roller surface, measured with an ASKER-C type spring-controlled rubber hardness meter (manufactured by Kobunshi Keiki Co., Ltd.) according to Japan Rubber Association Standard SRIS0101. It is the value measured 30 seconds after the above hardness meter is brought into contact with a developing roller at a force of 10 N which has been left for 12 hours or more in an environment of normal temperature and normal humidity (23° C., 55% RH).

<Martens Hardness>

Figure 7:
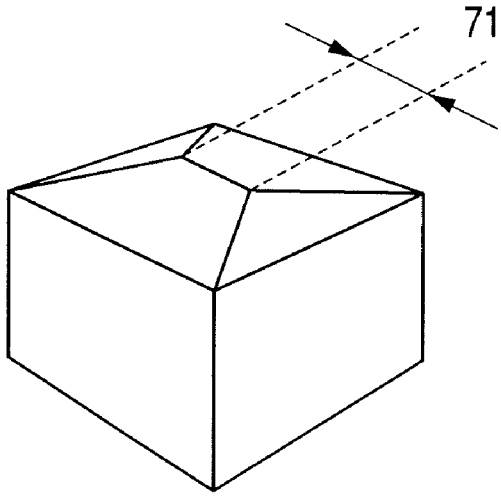
FIG. 7 is a view showing part of a Martens hardness measuring instrument.

Martens hardness was measured by the method described previously, using the ultra-microhardness test system PICODENTER HM500 (trade name; manufactured by Fischer Instruments KK). In measuring the Martens hardness of the developing roller surface and the Martens hardness of the elastic-material layer, a Vickers indenter (offset length (71 in FIG. 7): 0.3 μm was used, and the value was found under correction to the shape of a quadrangular pyramid.

<Contact Angle>

The contact angle of the developing roller surface in the present invention to diiodomethane was measured with a contact angle meter CA-5 ROLL (trade name), manufactured by Kyowa Interface Science Co., Ltd The contact angle was measured at three spots which were positions set by dividing the developing roller into four equal parts in its lengthwise direction, and the value found as an arithmetic means of the measurements was defined as a contact angle θd to diiodomethane. the measurement was made in an environment of temperature 25° C. and humidity 50% RH.

<Surface Free Energy and Dispersion Force Component Thereof>

The surface free energy of the developing roller surface in the present invention was measured using probe liquids shown in Table 1, the surface free energy three components of which were known.

TABLE 1

| | Kitazaki-Hata Theory | | | |
|---|---|---|---|---|
| Probe liquid | $\gamma L^d$ | $\gamma L^p$ | $\gamma L^h$ | $\gamma L^{Total}$ |
| Water | 29.1 | 1.3 | 42.4 | 72.8 |
| Diiodomethane | 46.8 | 4.0 | 0.0 | 50.8 |
| Ethylene glycol | 30.1 | 0.0 | 17.6 | 47.7 |

Unit: $mJ/m^2$

Specifically, also for probe liquids (water and ethylene glycol) other than diiodomethane, contact angles θ of the developing roller surface to the probe liquids were measured in the same way as in diiodomethane.

The surface free energies $\gamma L^d$, $\gamma L^p$, $\gamma L^h$ and $\gamma L^{Total}$ of the probe liquids in Table 1, water, diiodomethane and ethylene glycol, and the contact angles θ found using the respective probe liquids are substituted for the Kitazaki-Hata theory expression shown by the following expression (2) to prepare three expressions. The resultant simultaneous equations with three unknowns are solved to find the respective components $\gamma s^d$, $\gamma s^p$ and $\gamma s^h$ of the surface free energy of the developing roller surface, and then find the surface free energy (γTotal) that is the sum of $\gamma s^d$, $\gamma s^p$ and $\gamma s^h$ and the dispersion force component ($\gamma s^d$) of the surface free energy.

$$\sqrt{\gamma_L^d \gamma_S^d} + \sqrt{\gamma_L^p \gamma_S^p} + \sqrt{\gamma_L^h \gamma_S^h} = \frac{\gamma_L(1+\cos\theta)}{2} \quad (2)$$

<Break of Cover Layer at Elongation>

The developing roller was cut at a plane which passed along a straight line connecting two points adjoining to one another when the peripheral surface of the developing roller was divided into six equal parts in its peripheral direction (when viewed from a section, a chord of an arc corresponding to ⅙ of the outer circumference) and was parallel to the center line of the mandrel, to cut out a rubber piece having an elastic-material layer and a cover layer formed thereon This corresponds to the part cut off from the developing roller in the process made when the Martens hardness H2 ($N/mm^2$) of the elastic-material layer portion is measured. The rubber piece thus obtained was cut in a length of 100 mm, and was, at positions of 40 mm and 60 mm in its peripheral direction, so stamped as to be 20 mm in distance between gauge marks to obtain a test sample. This test sample was set in a constant-rate extending jig for vulcanized-rubber tensile permanent set testing (manufactured by Dumbbell Co., Ltd.), and was so extended as to come to be 21 mm in distance between gauge marks. After this was left standing for 5 minutes, the test sample was detached from the constant-rate extending jig. The state of the cover layer of the test sample subjected to 5% stretch deformation between the gauge marks was visually observed to judge whether or not the cover layer was broken. This was tested in an environment of temperature 25° C.±2° C. and relative humidity 50% RH±5%.

<DBP Absorption>

DBP absorption was measured for the carbon black which was present in the elastic-material layer and isolated from the elastic-material layer by the following procedure, and according to JIS K 6217-4 "Carbon Black for Rubber, Basic Properties, Part IV: How to Determine DBP Absorption".

The carbon black was taken out and isolated from the elastic-material layer in the following way. The elastic-material layer 12 was cut out of the developing roller, and made into pieces of about 1 to 2 mm square to prepare elastic-material layer pieces, which were then heated in a rotary kiln at a high temperature for a certain time in a stream of nitrogen to decompose rubber components. From the resulting residues, the carbon black component was recovered. The temperature and time therefor may be selected depending on the type, quantity and so forth of the rubber contained in the elastic-material layer. The silicone rubber can be decomposed by heating at 750° C. for 15 minutes. The rubber is decomposed into hydrocarbons and/or oil. Where, in the resulting residue, inorganic additives such as silica, quartz and talc are contained in addition to the carbon black component, they were separated by utilizing their differences in specific gravity. A method for taking carbon black out of the elastic-material layer to isolate the carbon black is by no means limited to the above, and any methods commonly used may be used.

Example 1

Developing Roller 1

A mandrel (diameter: 6.0 mm) made of SUS stainless steel and having been plated with nickel was used, with the mandrel coated on the peripheral surface thereof with an adhesive (primer) DY39-051A/B (trade name; available from Dow Corning Toray Co., Ltd.) and then baked.

The following raw materials were readied as raw materials for elastic-material layer formation.

Liquid silicone rubber 100 parts by mass (an addition type silicone rubber composition prepared by mixing a polysiloxane mixture composed of 40% by mass of a straight-chain polydimethylsiloxane terminated with vinyl groups, having a viscosity of 12,000 Pa·s at 25° C. and 60% by mass of a block polymer having a viscosity of 40 Pa·s at 25° C. and composed of a branched polysiloxane segment having one vinyl group and a straight-chain oil segment having continuously 200 bifunctional dimethylsiloxane bonds, with an organosiloxane as a cross-linking agent having 2.4 silicon-bonded hydrogen atoms per molecule on the average and a platinum type catalyst)

| | |
|---|---|
| Silica powder (AEROSIL 130: trade name; available from Nippon Aerosil Co., Ltd.) | 15 parts by mass |
| Quartz powder (Min-U-Sil 15: trade name; available from U.S. Silica Company) | 60 parts by mass |
| Carbon black (conductive agent; DENKA BLACK Particulate Product: trade name; available from Denki Kagaku Kogyo K.K.) | 20 parts by mass |

The above raw materials were mixed to prepare a conductive liquid rubber compound.

The mandrel described previously was placed in a mold and the above liquid rubber compound was injected into a cavity formed in the mold. Then, this mold was heated at 120° C. for 8 minutes, and thereafter cooled to room temperature, followed by demolding. The silicone rubber obtained was again heated at 200° C. for 60 minutes to effect vulcanization and curing, thus the mandrel was provided on the peripheral surface thereof with an elastic-material layer of 3.0 mm in thickness.

Figure 5:
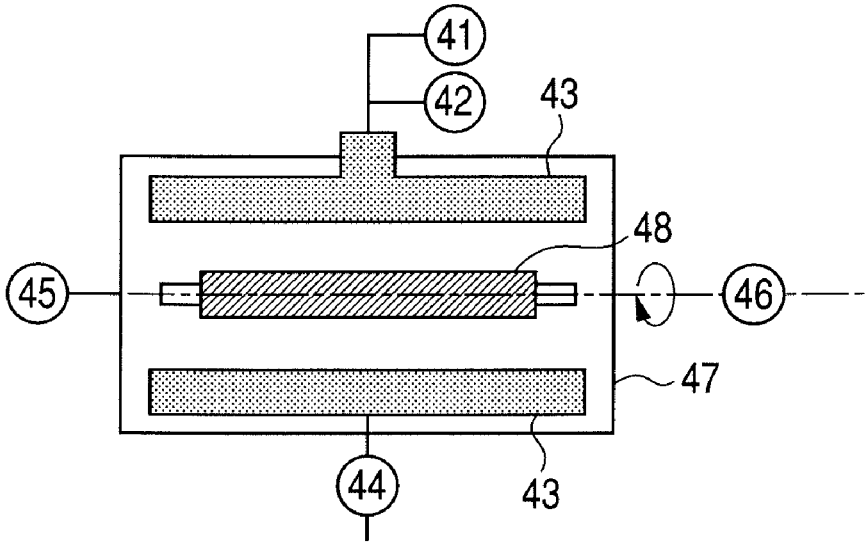
FIG. 5 is a schematic structural view showing an example of a CVD system as an apparatus for forming a cover layer of the developing roller of the present invention.

A roller having the elastic-material layer obtained by the method described above is designated as "silicone elastic-material layer roller 0". This silicone elastic-material layer roller 0 was set in a plasma CVD system shown in FIG. 5, and, while the roller was rotated at 20 rpm, raw-material gases were fed to form a cover layer on the peripheral surface of the elastic-material layer to produce Developing Roller 1. In FIG. 5, reference numeral 41 denotes a reaction gas feeding part; 42, a rare gas feeding part; 43, a pair of electrodes disposed in parallel; 44, a high-frequency power source; 45, an evacuation means which evacuate the interior of a chamber 47; 46, a rotating units which rotates an elastic-material roller 48 placed in the chamber 47.

As the raw-material gases for cover layer formation, a mixed gas of the following gases was used.

| | |
|---|---|
| Hexamethyldisiloxane vapor | 1.0 sccm |
| Oxygen | 0.5 sccm |
| Argon gas | 23.5 sccm |

Here, "sccm" represents a volumetric flow rate at 1 $cm^3$ (cubic centimeter) per minute when the raw-material gas is at 0° C. and 1 atmospheric pressure. The cover layer was formed by high-frequency heat treatment carried out for 4 minutes, setting the pressure in the vacuum chamber at 25.3 Pa, and at a frequency of 13.56 MHz and at a power of 120 W.

As the hexamethyldisiloxane, a first-grade product of 99% in purity was used; as the oxygen, a gas of 99.999% or more in purity; and as the argon gas, a gas of 99.999% or more in purity.

The abundance ratio of elements in the cover layer thus formed, composed of an SiOx film, was determined in the following way. Using an X-ray photoelectron spectrometer (trade name: QUANTUM 2000; manufactured by Ulvac-Phi, Inc.), the surface layer (cover layer) 13 of the developing roller was irradiated with AlKα from an X-ray source to measure peaks due to bond energy of the 2p orbital of Si and the 1 s orbital of O. The abundance ratio of each of the atoms was calculated from each of the peaks, and based on the abundance ratios, the value of O/Si was found.

As for the chemical bond of $SiO_x$, the surface of the $SiO_x$ film was examined by IR measurement with a Fourier transform infrared spectrophotometer (FT-IR instrument) (trade name: SpectrumOne; manufactured by PerkinElmer Japan Co., Ltd.). More specifically, the presence of the Si—O chemical bond was ascertained by the presence of an Si—O oscillation peak (450 $cm^{-1}$). As a result, the value of O/Si of the $SiO_x$ film according to this Example was 1.03.

Example 2

Developing Roller 2

Developing Roller 2 was produced in the same way as in Example 1 except that, in the raw-material gases, oxygen and argon gas were fed at 1.0 sccm and 23.0 sccm, respectively. The value of O/Si of the $SiO_x$ film according to this Example was 1.29.

Example 3

Developing Roller 3

Developing Roller 3 was produced in the same way as in Example 1 except that, in the raw-material gases, oxygen and argon gas were fed at 1.5 sccm and 22.5 sccm, respectively. The value of O/Si of the $SiO_x$ film according to this Example was 1.56.

Example 4

Developing Roller 4

Developing Roller 4 was produced in the same way as in Example 1 except that, in the raw-material gases, oxygen and argon gas were fed at 2.0 sccm and 22.0 sccm, respectively. The value of O/Si of the $SiO_x$ film according to this Example was 1.66.

Example 5

Developing Roller 5

Developing Roller 5 was produced in the same way as in Example 1 except that, in the raw-material gases, oxygen and argon gas were fed at 2.5 sccm and 21.5 sccm, respectively. The value of O/Si of the $SiO_x$ film according to this Example was 1.77

Example 6

Developing Roller 6

Developing Roller 6 was produced in the same way as in Example 1 except that, in the raw-materials, silica powder was used in an amount of 20 parts by mass, quartz powder was used in an amount of 70 parts by mass and carbon black was changed to DENKA BLACK FX-35 (trade name; available from Denki Kagaku Kogyo K.K.). The value of O/Si of the $SiO_x$ film according to this Example was 1.03.

Example 7

Developing Roller 7

Developing Roller 7 was produced in the same way as in Example 1 except that the raw-materials and conditions were changed as below. The value of O/Si of the $SiO_x$ film according to this Example was 1.77 silica powder: used in an amount of 10 parts by mass;

quartz powder: used in an amount of 40 parts by mass;

carbon black: changed to TOKA BLACK #7350F (trade name; available from Tokai Carbon Co., Ltd.); and carbon black: used in an amount of 40 parts by mass.

oxygen: fed at 2.5 sccm; and argon gas: fed at 21.5 sccm.

Example 8

Developing Roller 8

Developing Roller 8 was produced in the same way as in Example 1 except that the raw-materials and conditions were changed as shown below. The value of O/Si of the $SiO_x$ film according to this Example was 1.90.

silica powder: used in an amount of 10 parts by mass;

quartz powder: used in an amount of 40 parts by mass;

carbon black: changed for TOKA BLACK #7350F (trade name; available from Tokai Carbon Co., Ltd.); and carbon black: used in an amount of 40 parts by mass.

oxygen and argon gas: fed at 2.8 sccm and 21.2 sccm, respectively.

Example 9

Developing Roller 9

Developing Roller 9 was produced in the same way as in Example 1 except that the cover layer raw-material gases oxygen and argon gas were fed at 1.5 sccm and 22.5 sccm, respectively, and the high-frequency heat treatment was carried out for 30 seconds The value of O/Si of the $SiO_x$ film according to this Example was 1.56.

Example 10

Developing Roller 10

Developing Roller 10 was produced in the same way as in Example 1 except that, in the raw-material gases, oxygen and argon gas were fed at 1.5 sccm and 22.5 sccm, respectively, and the high-frequency heat treatment was carried out for 90 seconds. The value of O/Si of the $SiO_x$ film according to this Example was 1.56.

Example 11

Developing Roller 11

Developing Roller 11 was produced in the same way as in Example 1 except that the materials and conditions were changed as below. The value of O/Si of the $SiO_x$ film according to this Example was 1.77.

silica powder: used in an amount of 40 parts by mass; and carbon black: changed for DENKA BLACK FX-35 (trade name; available from Denki Kagaku Kogyo K.K.).

oxygen: fed at 2.5 sccm; and argon gas: fed at 21.5 sccm.

Example 12

Developing Roller 12

The following raw materials were readied as raw materials for elastic-material layer formation.

| | |
|---|---|
| Rubber (NBR, JSR N230L: trade name; available from JSR Corporation) | 100 parts by mass |
| Zinc oxide | 5.0 parts by mass |
| Stearic acid | 2.0 parts by mass |
| Calcium carbonate | 30 parts by mass |
| 2-Mercaptobenzimidazole (MB) | 0.5 part by mass |
| Carbon black (TOKA BLACK #7360SB, trade name; available from Tokai Carbon Co., Ltd.) | 35 parts by mass |
| Plasticizer (POLYCIZER P-202, trade name; available from DIC Corporation) | 20 parts by mass |

The above raw materials were kneaded for 10 minutes by means of a closed mixer set at 50° C. to prepare a rubber compound.

To this rubber compound, the following various additives were further added with respect to 100 parts by mass of the rubber (NBR in this Example), and were kneaded for 10 minutes by means of a twin-roll mill cooled to 20° C. to obtain an elastic-material layer compound.

| | |
|---|---|
| Dispersible sulfur (SULFAX 200S: trade name; available from Tsurumi Kagaku Kogyo K.K.) | 1.2 parts by mass |
| Di-2-benzothiazolyl disulfide (NOCCELER DM: trade name; available from Ouchi-Shinko Chemical Industrial Co., Ltd.) | 1.0 part by mass |
| Dipentamethylenethiuram tetrasulfide (NOCCELER TRA: trade name; available from Ouchi-Shinko Chemical Industrial Co., Ltd.) | 1.0 part by mass |

-continued

| | |
|---|---|
| Tetramethylthiuram monosulfide (NOCCELER TS: trade name; available from Ouchi-Shinko Chemical Industrial Co., Ltd.) | 0.5 parts by mass |

The above elastic-material layer compound was formed into a tubular shape by extrusion, and then primarily vulcanized at 130° C. for 30 minutes by steam vulcanization and further secondarily vulcanized at 140° C. for 30 minutes by means of an electric oven to prepare a tube made of rubber. This tube was cut and thereafter, into the tube, a mandrel (diameter: 6.0 mm) made of SUS stainless steel and plated with nickel was press-fitted, with the mandrel coated on the peripheral surface thereof with an adhesive (primer) and then baked. Subsequently, the tube surface was ground, and the mandrel was provided on the peripheral surface thereof with an elastic-material layer of 3 mm in thickness.

A roller having the elastic-material layer obtained by the method described above is designated as "NBR elastic-material layer roller 0". On the peripheral surface of this NBR elastic-material layer roller 0, a cover layer was formed. To form the cover layer, a mixed gas of the following gases was used as raw-material gases. Except for the following conditions, the same procedure as in Example 1 was repeated to produce Developing Roller 12. The value of O/Si of the $SiO_x$ film according to this Example was 1.56.

| | |
|---|---|
| Raw-material gases: a mixed gas of hexamethyldisiloxane vapor | 1.0 sccm |
| oxygen | 2.5 sccm |
| argon gas | 21.5 sccm |

High-frequency heat treatment: carried out for 5 minutes.

Example 13

Developing Roller 13

The following raw materials were readied as raw materials for elastic-material layer formation.

| | |
|---|---|
| Thermoplastic resin (SANTOPRENE 8211-25: trade name; available from AES Japan Co.) | 100 parts by mass |
| Plasticizer (POLYCIZER P-202, trade name; available from DIC Corporation) | 20 parts by mass |
| Carbon black (TOKA BLACK #7350F, trade name; available from Tokai Carbon Co., Ltd.) | 35 parts by mass |

These raw materials were kneaded by means of a twin-screw extruder of 30 mm in screw diameter D, 960 mm in length L and 32 mL/D to prepare resin composition pellets.

Separately, a mandrel (diameter: 6.0 mm) made of SUS stainless steel and plated with nickel was readied, with the mandrel coated on the peripheral surface thereof with an adhesive (primer) and then baked. Using this mandrel and the above resin composition pellets, an elastic-material layer made up of the resin composition was formed on the peripheral surface of the mandrel by means of an extruder having a cross-head die. The elastic-material layer formed was cut at both ends to remove surplus portions and was provided with bearing surfaces. Further, the elastic-material layer was ground with a rotary grinding stone, and the mandrel was provided on the peripheral surface thereof with an elastic-material layer of 3 mm in thickness.

A roller having the elastic-material layer obtained by the method described above is designated as "thermoplastic resin elastic-material layer roller 0". On the peripheral surface of this thermoplastic resin elastic-material layer roller 0, a cover layer was formed. To form the cover layer, a mixed gas of the following gases was used as raw-material gases. Except for the following conditions, the same procedure as in Example 1 was repeated to produce Developing Roller 13. The value of O/Si of the $SiO_x$ film according to this Example was 1.56.

| | |
|---|---|
| Raw-material gases: a mixed gas of hexamethyldisiloxane vapor | 1.0 sccm |
| oxygen | 2.5 sccm |
| argon gas | 21.5 sccm |

High-frequency heat treatment: carried out for 3 minutes.

Example 14

Developing Roller 14

Developing Roller 14 was produced in the same way as in Example 1 except that the materials and conditions were changed as shown below. The value of O/Si of the $SiO_x$ film according to this Example was 1.56.

Thermoplastic resin: changed to SANTOPRENE 8211-35 (trade name; available from AES Japan Co.); plasticizer: used in an amount of 15 parts by mass; carbon black: changed to TOKA BLACK #7350F (trade name; available from Tokai Carbon Co., Ltd.); and carbon black: used in an amount of 32 parts by mass.

Example 15

Developing Roller 15

Developing Roller 15 was produced in the same way as in Example 1 except that the materials and conditions were changed as shown below. The value of O/Si of the $SiO_x$ film according to this Example was 1.56.

Thermoplastic resin: changed to SANTOPRENE 8211-45 (trade name; available from AES Japan Co.); plasticizer: used in an amount of 10 parts by mass; and carbon black: used in an amount of 30 parts by mass.

Example 16

Developing Roller 16

The silicone elastic-material layer roller 0 was placed in a vacuum deposition system, and a fluorine resin (FLUON Fine Powder CD145: trade name; available from Asahi Glass Co., Ltd.) was put into a crucible. Thereafter, the interior of the vacuum deposition system was evacuated to 13.33 Pa. In this state, the temperature of the crucible was so adjusted to 650° C., and the roller was placed in the system for 3 minutes while being rotated at 20 rpm to form a cover layer on the roller. Except for the above, the same procedure as in Example 1 was repeated to produce Developing Roller 16.

Example 17

Developing Roller 17

Developing Roller 17 was produced in the same way as in Example 1 except that the treatment time in the vacuum deposition system was changed to 10 minutes.

Example 18

Developing Roller 18

Developing Roller 18 was produced in the same way as in Example 1 except that the treatment time in the vacuum deposition system was changed to 20 minutes.

Example 19

Developing Roller 19

Using toluene as a solvent, a fluorine resin solution was prepared by dissolving in the solvent 3.0% by mass of a solvent-soluble fluorine resin LUMIFLON (trade name; available from Asahi Glass Co., Ltd.). Into this solution, the silicone elastic-material layer roller 0 was dipped and then drawn up, followed by drying at 150° C. for 2 hours to form a cover layer. Except for the above, the same procedure as in Example 1 was repeated to produce Developing Roller 19.

Example 20

Developing Roller 20

Using N-methyl-2-pyrrolidone as a solvent, a resin solution was prepared by dissolving in the solvent 1.0% by mass of a polyimide varnish U-VARNISH-A (trade name; available from Ube Industries Ltd.). Into this solution, the silicone elastic-material layer roller 0 was dipped and then drawn up, followed by heat treatment at 150° C. for 4 hours, and further followed by heat treatment at 200° C. for 2 hours to form a cover layer. Except for the above, the same procedure as in Example 1 was repeated to produce Developing Roller 20.

Example 21

Developing Roller 21

Developing Roller 21 was produced in the same way as in Example 20 except that the amount of U-VARNISH-A in the resin solution was changed to 3.0% by mass.

Comparative Example 1

Developing Roller 22

Developing Roller 22 was produced in the same way as in Example 1 except that the materials and conditions were changed as shown below. The value of O/Si of the $SiO_x$ film according to this Comparative Example was 0.94.

silica powder: used in an amount of 20 parts by mass;

quartz powder: used in an amount of 70 parts by mass; and carbon black: changed to DENKA BLACK FX-35 (trade name; available from Denki Kagaku Kogyo K.K.).

| | |
|---|---|
| Raw-material gases: a mixed gas of hexamethyldisiloxane vapor | 1.2 sccm |
| oxygen | 0.3 sccm |
| argon gas | 23.5 sccm |

Comparative Example 2

Developing Roller 23

Developing Roller 23 was produced in the same way as in Example 1 except that, in the raw-materials, the silica powder was used in an amount of 40 parts by mass and the carbon black was changed to DENKA BLACK FX-35 (trade name; available from Denki Kagaku Kogyo K.K.) and, in the raw-material gases, the oxygen and the argon gas were fed at 3.0 sccm and 21.0 sccm, respectively. The value of O/Si of the $SiO_x$ film according to this Comparative Example was 1.98.

Comparative Example 3

Developing Roller 24

Developing Roller 24 was produced in the same way as in Example 1 except that, in the raw-materials, the rubber was changed to JSR N222L (trade name; available from JSR Corporation) and the carbon black was changed to MA230 (trade name; available from Mitsubishi Chemical Corporation). The value of O/Si of the $SiO_x$ film according to this Comparative Example was 1.56.

Comparative Example 4

Developing Roller 25

Developing Roller 25 was produced in the same way as in Example 16 except that the materials and conditions were changed as shown below.

Fluorine resin: changed to FLUON Fine Powder CD123 (trade name; available from Asahi Glass Co., Ltd.)

High-frequency heat treatment: carried out for 1 minute

Comparative Example 5

Developing Roller 26

Using N-methyl-2-pyrrolidone as a solvent, a resin solution was prepared by dissolving in the solvent 3.5% by mass of a polyimide varnish U-VARNISH-A (trade name; available from Ube Industries, Ltd.). Into this solution, the silicone elastic-material layer roller 0 was dipped and then drawn up, followed by heat treatment at 150° C. for 4 hours, and further followed by heat treatment at 200° C. for 2 hours to form a cover layer. Except for the above, the same procedure as in Example 1 was repeated to produce Developing Roller 26.

Comparative Example 6

Developing Roller 27

The "silicone elastic-material layer roller 0" was obtained by the method shown in Example 1.

The following raw materials were readied as raw materials for coating material preparation.

Polyol (NIPPOLAN 5196: trade name; available from Nippon Polyurethane Industry Co., Ltd.).

Hardening agent (an isocyanate "COLONATE L": trade name; available from Nippon Polyurethane Industry Co., Ltd.).

Conductive agent (carbon black "MA11": trade name; available from Mitsubishi Chemical Corporation).

To the above NIPPOLAN 5196 (100 parts by mass as solid content), COLONATE L (4 parts by mass as solid content) and 22 parts by mass of carbon black "MA11" were added, followed by further addition of methyl ethyl ketone. The resultant was thoroughly stirred to prepare a coating fluid (solid content: 9.5%). Into this coating fluid, the above "silicone elastic-material layer roller 0" was dipped to effect coating and then drawn up, followed by heat treatment at 145° C. for 30 minutes to provide an elastic-material layer of 15 μm in thickness on the peripheral surface of the elastic-material layer. Except for the above, the same procedure as in Example 1 was repeated to produce Developing Roller 27.

Reference Example 1

Developing Roller 28

The silicone elastic-material layer roller 0 obtained in Example 1 was not provided with a cover layer, and this roller itself was used as Developing Roller 28.

The DBP absorption (measured value before use) of carbon black used in each of the Examples and Comparative Examples are shown in Table 2.

TABLE 2

| Trade name | (available from) | DBP absorption (ml/100 g) |
|---|---|---|
| DENKA BLACK Particulate Product | Denki Kagaku Kogyo | 160 |
| DENKA BLACK FX-35 | Denki Kagaku Kogyo | 220 |
| TOKA BLACK #7350F | Tokai Carbon | 106 |
| TOKA BLACK #7360SB | Tokai Carbon | 87 |
| MA230 | Mitsubishi Chemical | 113 |

In Example 12, the elastic-material layer contains a cross-linked rubber and contains carbon black having a DBP absorption of 87 ml/100 g. Likewise, in Examples 13, 14 and 15, the elastic-material layer contains a thermoplastic elastomer and contains carbon black having a DBP absorption of 106 ml/100 g.

The cover layers in Examples 1 to 15 and Comparative Examples 1 to 3 each contain a material composed chiefly of $SiO_x$.

The following values of Developing Rollers 1 to 28 produced are shown in Tables 3 and 4.

In Table 3;

Asker-C hardness of developing roller surface;

Martens hardness of developing roller surface;

Martens hardness of elastic-material layer portion;

Layer thickness (d) of cover layer; and

Value of (H1−H2)/d.

In Table 4;

Contact angle of developing roller surface to diiodomethane;

Surface free energy of developing roller surface;

Dispersion force component; and

Break of cover layer at elongation.

In regard to the break of cover layer at elongation, as a result of evaluation on Developing Rollers 8 and 23, no break was detected in visual observation, but the surfaces of their cover layers were observed to be a little cloudy. For reference, Developing Rollers 8 and 23 were additionally observed with an optical microscope, but no break was observed in their cover layers.

TABLE 3

| | Developing roller No. | Asker-C hardness of developing roller surface (°) | Martens hardness (H1) ($N/mm^2$) | Martens hardness (H2) ($N/mm^2$) | Layer thickness (d) of cover layer | (H1 − H2)/d ($N/mm^2$) |
|---|---|---|---|---|---|---|
| Example | | | | | | |
| 1 | 1 | 51 | 2.11 | 1.15 | 1820 | 527 |
| 2 | 2 | 56 | 2.34 | 1.15 | 1785 | 667 |
| 3 | 3 | 59 | 2.41 | 1.15 | 1690 | 746 |
| 4 | 4 | 63 | 2.67 | 1.15 | 1740 | 874 |
| 5 | 5 | 67 | 2.94 | 1.15 | 1660 | 1078 |
| 6 | 6 | 74 | 2.08 | 1.36 | 1780 | 404 |
| 7 | 7 | 42 | 2.96 | 1.02 | 1750 | 1109 |
| 8 | 8 | 45 | 3.11 | 1.02 | 1680 | 1244 |
| 9 | 9 | 46 | 1.71 | 1.15 | 290 | 1931 |
| 10 | 10 | 48 | 2.25 | 1.15 | 760 | 1447 |
| 11 | 11 | 77 | 2.96 | 1.41 | 1710 | 906 |
| 12 | 12 | 82 | 3.22 | 1.66 | 2140 | 729 |
| 13 | 13 | 50 | 2.23 | 1.18 | 1310 | 802 |
| 14 | 14 | 67 | 2.71 | 1.38 | 1290 | 1031 |
| 15 | 15 | 85 | 3.15 | 1.72 | 1280 | 1117 |
| 16 | 16 | 56 | 1.61 | 1.15 | 240 | 1917 |
| 17 | 17 | 62 | 2.44 | 1.15 | 840 | 1536 |
| 18 | 18 | 71 | 2.57 | 1.15 | 1550 | 916 |
| 19 | 19 | 85 | 4.11 | 1.15 | 4700 | 630 |
| 20 | 20 | 53 | 2.35 | 1.15 | 1070 | 1121 |
| 21 | 21 | 74 | 3.22 | 1.15 | 3470 | 597 |
| Comparative Example | 22 | 38 | 1.97 | 1.02 | 1720 | 552 |
| 1 | | | | | | |
| 2 | 23 | 87 | 5.45 | 1.41 | 1710 | 2363 |
| 3 | 24 | 88 | 3.44 | 1.88 | 2110 | 739 |
| 4 | 25 | 53 | 1.41 | 1.15 | 85 | 3059 |
| 5 | 26 | 88 | 3.66 | 1.15 | 6700 | 375 |
| 6 | 27 | 51 | 4.05 | 1.02 | 15000 | 202 |
| Reference Example 1 | 28 | 46 | 1.36 | 1.36 | * No cover layer | — |

TABLE 4

| | | Contact angle to diiodomethane | Surface free energy | Dispersion force component | Break of cover layer at elongation |
|---|---|---|---|---|---|
| Example | 1 | 56.7 | 31.4 | 17.9 | No |
| | 2 | 59.5 | 30.6 | 18.7 | No |
| | 3 | 62.1 | 29.4 | 20.1 | No |
| | 4 | 65.8 | 26.3 | 21.2 | No |
| | 5 | 67.9 | 23.6 | 22.3 | No |
| | 6 | 56.9 | 31.2 | 17.8 | No |
| | 7 | 67.4 | 23.8 | 22.0 | No |
| | 8 | 68.5 | 22.6 | 20.8 | No |
| | 9 | 62.0 | 29.5 | 20.2 | No |
| | 10 | 62.1 | 29.3 | 20.0 | No |
| | 11 | 68.1 | 23.5 | 22.1 | No |
| | 12 | 62.4 | 29.2 | 19.9 | No |
| | 13 | 62.2 | 29.4 | 20.2 | No |
| | 14 | 62.3 | 29.3 | 20.0 | No |
| | 15 | 62.1 | 29.5 | 20.1 | No |
| | 16 | 42.5 | 38.6 | 24.1 | No |
| | 17 | 42.3 | 38.7 | 24.2 | No |
| | 18 | 42.6 | 38.5 | 24.1 | No |
| | 19 | 46.4 | 31.9 | 25.0 | No |
| | 20 | 54.6 | 33.0 | 22.5 | No |
| | 21 | 54.8 | 32.9 | 22.4 | No |
| Comparative Example | 1 | 53.1 | 32.2 | 16.5 | No |
| | 2 | 68.9 | 21.6 | 20.3 | No |
| | 3 | 62.2 | 29.6 | 20.4 | No |
| | 4 | 41.9 | 39.1 | 24.4 | No |
| | 5 | 51.5 | 34.6 | 17.2 | Yes |
| | 6 | 36.5 | 41.9 | 35.8 | No |
| Reference Example 1 | | 96.3 | 10.3 | 9.6 | — |

For Developing Rollers 1 to 28 produced, evaluation was made in the following way.

Contamination of Photosensitive Drum:

Each developing roller was set into Toner Cartridge 311 (cyan) (trade name; manufactured by CANON Inc.) as a process cartridge, and was left standing for 14 days in an environmental tester of 35° C.±2° C. in room temperature and 85% RH±5% in relative humidity. Thereafter, the cartridge was disassembled to visually observe whether or not contamination is present on the latent image bearing member surface. The developing roller was set in the cartridge, taken apart therefrom and observed in an environment of temperature 25° C.±2° C. and relative humidity 50% RH±5%.

"no": No contamination is observed on the latent image bearing member surface.

"yes": contamination is observed on the latent image bearing member surface.

<Image Evaluation>

An electrographic image forming apparatus was readied which was a color printer SATERA LBP5400 (trade name; manufactured by CANON Inc.) the output speed of which was converted to 25 sheets/minute in A4 size (hereinafter also "modified machine"). This color printer is of a tandem type which has cyan, magenta, yellow and black color cartridges and an image writing means (laser) provided for each cartridge, and has a transfer belt. The standard image formation capacity is 21 sheets/minute in A4 size.

The color cartridges are each provided with a photosensitive drum, a charging roller, a developing roller, a toner feed roller and a control blade (which are adaptable to a one-component contact development system), and the developing roller is disposed in contact with the photosensitive drum. Further, the color cartridges are each provided with a cleaning blade in touch with the photosensitive drum. In this color printer, Developing Rollers 1 to 28 were each set as the developing roller of the cyan cartridge provided with a pre-exposure means for eliminating electric charges remaining on the photosensitive drum before being charged by the charging roller. The magenta, yellow and black color cartridges were disposed at their respective stations after toners were removed and further their toner level detecting mechanisms were set to be inoperable.

These color cartridges were each mounted on the above conversion machine, and electrographic images were reproduced in a low temperature and low humidity environment (temperature: 15° C.±2° C.; relative humidity: 20% RH±5%) and a high temperature and high humidity environment (temperature: 30° C.±2° C.; relative humidity: 80% RH±5%). The images thus formed were evaluated in the following way. As transfer materials, sheets of letter size plain paper (trade name: XEROX 4024 sheets; available from Fuji Xerox Co., Ltd.) were used.

<Evaluation on Density Non-Uniformity in Image>

Figure 6:
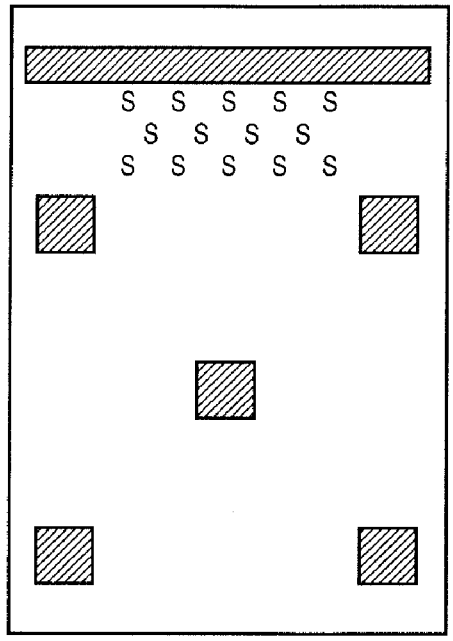
FIG. 6 is a view showing an original image used in image evaluation made by means of an electrographic image forming apparatus of the present invention.

Image reproduction was tested over a period of 11 days in the low temperature and low humidity environment (temperature: 15° C.±2° C.; relative humidity: 20% RH±5%) to make an evaluation on density non-uniformity in images obtained on the first day and on 11th day. Specifically, the following was carried out. First day: Images of a standard chart (letter size; solid black areas at six spots and letters S are arranged in a print percentage of 4%) as shown in FIG. 6 were printed on 9 sheets; a solid image uniform in the whole image region, on 1 sheet; a whole-area halftone image, on 1 sheet; and images of the standard chart, on 389 sheets; continuously.

Second day to tenth day: Images of the standard chart were continuously printed on 400 sheets.

Eleventh day: Images of the standard chart were printed on 9 sheets; the solid image, on 1 sheet; and the halftone image, on 1 sheet; continuously.

Then, the solid image (reproduced on the 10th sheet) and halftone image (reproduced on the 11th sheet) formed on the first day were visually observed on whether or not the images had density non-uniformity, and were evaluated according to the following criteria, which was regarded as evaluation on density non-uniformity in initial-stage images formed using the developing roller. The solid image (reproduced on the 4,010th sheet) and halftone image (reproduced on the 4,011th sheet) formed on the eleventh day were evaluated in the same way, which was regarded as evaluation on density non-uniformity in images formed over time.

A: Image density non-uniformity is not observed in both the solid image and the halftone image.

B: Image density non-uniformity is observed in the solid image, but not observed in the halftone image.

C: Image density non-uniformity is observed in both the solid image and the halftone image.

<Evaluation on Image Vertical Line>

Image reproduction was tested over a period of 11 days in the high temperature and high humidity environment (temperature: 30° C.±2° C.; relative humidity: 80% RH±5%) to make an evaluation on density non-uniformity of images obtained on the first day and on 11th day. Specifically, the following was carried out. First day: Images of a standard chart (letter size; solid black areas at six spots and letters S are arranged in a print percentage of 4%) as shown in FIG. 6 were printed on 9 sheets; a solid image uniform in the whole image region, on 1 sheet; a whole-area halftone image, on 1 sheet; and images of the standard chart, on 389 sheets; continuously.

Second day to tenth day: Images of the standard chart were continuously printed on 400 sheets.

Eleventh day: Images of the standard chart were printed on 9 sheets; the solid image, on 1 sheet; and the halftone image, on 1 sheet; continuously.

Then, the solid image (reproduced on the 10th sheet) and halftone image (reproduced on the 11th sheet) formed on the first day were visually observed on whether or not the images have vertical line-shaped density non-uniformity, and were evaluated according to the following criteria, which was regarded as evaluation on vertical lines (image lines due to toner melt adhesion to the control member) in initial-stage images formed using the developing roller. The solid image (reproduced on the 4,010th sheet) and halftone image (reproduced on the 4,011th sheet) formed on the eleventh day were evaluated in the way, which was regarded as evaluation on vertical lines in images formed over time.

A: vertical lines are not observed in both the solid image and the halftone image.

B: Vertical lines are observed in the solid image, but not observed in the halftone image.

C: Vertical lines are observed in both the solid image and the halftone image, where the number of the vertical lines observed in the solid image is 5 or more <Evaluation of Contact-Part Image>

Developing Rollers 1 to 28 were each set into the cyan color cartridge, and thereafter each cartridge was left standing for 60 days in an environment of 25° C.±2° C. and 50% RH±5%. Thereafter, in the same environment, images of the above standard chart were reproduced on 9 sheets; the solid image, on 1 sheet; and the halftone image, on 1 sheet; continuously. The solid image (reproduced on the 10th sheet) and halftone image (reproduced on the 11th sheet) formed on the first day, were visually observed on whether or not the images have line-shaped density non-uniformity in the direction perpendicular to the image print direction in the developing roller revolution, and were evaluated according to the following criteria. The line-shaped density non-uniformity occurs at the position corresponding to the contact part where the control blade 24 comes in touch with the developing roller 1 surface.

A: Line-shaped density non-uniformity is not observed in both the solid image and the halftone image.

B: Line-shaped density non-uniformity is observed in the solid image, but not observed in the halftone image C: Line-shaped density non-uniformity is observed in both the solid image and the halftone image.

The results of evaluation made according to the above criteria are shown in Table 5.

As shown in Table 5, good results were obtained in Examples 1 to 21. In particular, especially good results were obtained in Examples 3, 4, 5 and 7

TABLE 5

| | | Image evaluation | | | | |
|---|---|---|---|---|---|---|
| | Staining to photo- | Image density nonuniformity | | Image vertical line | | Contact- |
| | sensitive drum | 1st day | 11th day | 1st day | 11th day | part image |
| Example | | | | | | |
| 1 | no | A | B | A | A | B |
| 2 | no | A | B | A | A | A |
| 3 | no | A | A | A | A | A |
| 4 | no | A | A | A | A | A |
| 5 | no | A | A | A | A | A |
| 6 | no | A | B | A | A | B |
| 7 | no | A | A | A | A | A |
| 8 | no | A | A | A | B | A |
| 9 | no | A | A | A | B | B |
| 10 | no | A | A | A | B | B |
| 11 | no | A | A | A | B | A |
| 12 | no | A | A | A | B | B |
| 13 | no | A | A | A | A | B |
| 14 | no | A | A | A | A | B |
| 15 | no | A | A | A | A | B |
| 16 | no | A | A | A | B | B |
| 17 | no | A | A | C | B | B |
| 18 | no | A | A | A | A | B |
| 19 | no | A | B | A | A | B |
| 20 | no | A | A | A | B | B |
| 21 | no | A | B | A | A | B |
| Comparative Example | | | | | | |
| 1 | yes (slightly) | A | B | A | B | C |
| 2 | no | B | C | A | C | A |
| 3 | no | B | C | A | B | A |
| 4 | yes (slightly) | A | A | A | C | B |
| 5 | no | C | C | A | B | A |
| 6 | no | A | C | A | B | B |
| Reference Example 1 | yes | — | — | — | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-118782, filed Apr. 27, 2007, which is hereby incorporated by reference herein in its entirety.

What is claimed is:

1. A developing roller comprising:

a mandrel;

an elastic material layer; and a cover layer as a surface layer which covers the elastic material layer, wherein the developing roller has an Asker-C hardness of 40° or more and 85° or less at the surface of the cover layer, wherein the cover layer has a thickness of 15 nm or more and 5,000 nm or less, and wherein a Martens hardness H1 ($N/mm^2$) at the surface of the developing roller a Martens hardness H2 ($N/mm^2$) of the elastic material layer and the thickness d (mm) of the cover layer satisfy a relationship of the following expression:

$$400 \leqq (H1-H2)/d \leqq 2{,}000.$$

2. The developing roller according to claim 1, wherein the surface of the cover layer has a contact angle of 40° or more and 70° or less to diiodomethane.

3. The developing roller according to claim 1, wherein, when a strip specimen cut out of the developing roller, including the cover layer and the elastic material layer, is subjected to 5% stretch deformation, no break occurs in the cover layer.

4. The developing roller according to claim 1, wherein the cover layer contains a material consisting essentially of $SiO_x$, which is formed by a plasma CVD process.

5. The developing roller according to claim 1, wherein the elastic material layer contains a cross-linked rubber or a thermoplastic elastomer, and contains, as a conductive agent, carbon black having a DBP absorption of 50 ml/100 g or more and 110 ml/100 g or less.

6. A developing assembly comprising:

a developing roller which holds a toner thereon in a state of facing a latent image bearing member that holds an electrostatic latent image therein; and a control blade which controls a layer thickness of the toner while triboelectrically charging the toner held on the developing roller, the developing roller providing the latent image bearing member with the toner to develop the electrostatic latent image, wherein the developing roller is a developing roller according to claim 1.

7. A process cartridge comprising:

a latent image bearing member;

a means for charging the surface of the latent image bearing member; and a means for developing an electrostatic latent image formed on the latent image bearing member, wherein the means for developing the electrostatic latent image is the developing assembly according to claim 6.

8. An image forming apparatus comprising:

a latent image bearing member on which an electrostatic latent image is formed by an electrophotographic system;

a means for charging the latent image bearing member;

a means for forming the electrostatic latent image in a charged region of the latent image bearing member;

a means for applying a toner to the electrostatic latent image to render the electrostatic latent image visible as an image of the toner; and a means for transferring the image of the toner to a transfer material, wherein the means for rendering the electrostatic latent image visible as an image of the toner is the developing assembly according to claim 6.

9. The developing roller according to claim 1, wherein the cover layer contains a material consisting essentially of fluorine resin.

10. The developing roller according to claim 1, wherein the cover layer contains a material consisting essentially of polyimide resin.

* * * * *